US009363603B1

(12) United States Patent
Cabot

(10) Patent No.: US 9,363,603 B1
(45) Date of Patent: Jun. 7, 2016

(54) SURROUND AUDIO DIALOG BALANCE ASSESSMENT

(71) Applicant: XFRM INCORPORATED, Lake Oswego, OR (US)

(72) Inventor: Richard C. Cabot, Lake Oswego, OR (US)

(73) Assignee: XFRM Incorporated, Lake Oswego, OR (US)

( * ) Notice: Subject to any disclaimer, the term of this patent is extended or adjusted under 35 U.S.C. 154(b) by 337 days.

(21) Appl. No.: 13/778,080

(22) Filed: Feb. 26, 2013

(51) Int. Cl.
*H04R 29/00* (2006.01)
*H04R 5/04* (2006.01)

(52) U.S. Cl.
CPC ..... *H04R 5/04* (2013.01)

(58) Field of Classification Search
CPC ..... H04R 5/00; H04B 1/00
USPC ..... 381/27, 22–23, 119, 56, 58
See application file for complete search history.

(56) References Cited

U.S. PATENT DOCUMENTS 5,751,819 A * 5/1998 Dorrough ..... H04R 29/008 381/119
5,878,391 A 3/1999 Aarts
5,930,375 A 7/1999 East et al.
5,946,352 A 8/1999 Rowlands et al.
6,061,647 A 5/2000 Barrett
6,507,658 B1 * 1/2003 Abel ..... H04S 3/00 381/17
6,658,380 B1 12/2003 Lockwood et al.
6,973,184 B1 * 12/2005 Shaffer et al. ..... 379/420.01
7,251,337 B2 * 7/2007 Jacobs ..... H04S 7/00 381/104
7,394,903 B2 7/2008 Herre et al.
7,450,727 B2 11/2008 Griesinger
7,929,717 B2 * 4/2011 Okabayashi et al. ..... 381/119
8,050,434 B1 11/2011 Kato et al.
8,483,397 B2 * 7/2013 Deschamp ..... H04S 7/40 381/306
2010/0290630 A1 * 11/2010 Berardi ..... H04S 7/30 381/17
2011/0054887 A1 * 3/2011 Muesch ..... H04R 5/04 704/225
2014/0153742 A1 * 6/2014 Hershey et al. ..... 381/94.1

* cited by examiner

*Primary Examiner* — Disler Paul
(74) *Attorney, Agent, or Firm* — Law Office of Karen Dana Oster, LLC

(57) ABSTRACT

A surround audio dialog balance assessment method, apparatus, and system as disclosed herein is an audio monitor or is associated with an audio monitor. Preferred surround audio dialog balance assessment methods, apparatuses, and systems automate the process of monitoring audio signals through a broadcast chain.

21 Claims, 7 Drawing Sheets

SURROUND AUDIO DIALOG BALANCE ASSESSMENT

BACKGROUND OF INVENTION

Disclosed herein is a surround audio dialog balance assessment method, apparatus, and system, and more particularly, disclosed herein is a surround audio dialog balance assessment method, apparatus, and system that is an audio monitor or is associated with an audio monitor.

Audio is very important in "broadcast programs" (also referred to as "programs") such as television or film programs. One type of audio is "surround sound" (also referred to as "surround"). The surround sound for a broadcast programs may be referred to as "surround sound programs" or "surround programs." Surround sound encompasses a range of techniques for reproduction of an audio source (including at least one audio signal) with audio channels (including at least one audio signal) reproduced using multiple discrete speakers. A surround sound system creates the illusion of multi-directional sound through speaker placement and signal processing. Surround sound is characterized by a listener location or sweet spot where the audio effects work best, and presents a fixed or forward perspective of the sound field to the listener at this location. One exemplary type of surround sound has five channels: center front channel CF, left front channel LF, right front channel RF, left surround channel LS (left rear channel), and right surround channel RS (right rear channel).

It is common practice in television and film production to place dialog (e.g. speech such as spoken voice(s) of people, characters, and/or narrators) only in the center front channel. For purposes of description, the center front channel will be used as an exemplary dialog transmitting channel. Ambient sounds, sound effects, and music ("competing program content") are placed in the other four surround channels and in the low frequency effects (LFE) channel. It is the mix engineer's job to balance the audio signal content in each channel to make a pleasing and realistic audio presentation that complements the visual presentation. The balance between the dialog and the competing program content between channels is sometimes called "channel balance."

When mixing surround programs, it is important to keep the dialog louder than the competing program content so the dialog remains intelligible. As a guide to accomplishing this, professional sound mixers are often instructed to maintain a minimum level difference between the center front and the left and right front channels. The levels (typically measured using volume unit (VU) meters or peak program meters (PPM)) of these three front channels are displayed on meters of virtually all mixing consoles FIG. 1. The meters are usually in close physical proximity to each other, typically arranged in the order left front 110, right front 120, and center front 130. This makes comparisons between the channel levels shown on the meters relatively easy, and thus the visual comparison technique has become a common practice.

The left and right front levels are often, but not always, representative of the overall surround program level. A common exception is when mixing live sports and crowd noise occurs in the surround channels 150, 160. In this situation a better guideline would be to compare the center front level to each of the other surround channels in the surround program. However, this would be far more difficult because of the larger number of meters involved, their larger physical separation in a typical console, and the presence of the LFE channel meter 140, usually next to the center front meter 130, which would not be involved in the comparison.

Even when performing the simpler task of comparing center front level to the left and right front levels, continuous attention is required. If the user is not looking at the meters, intelligibility may inadvertently drop to an unacceptable level.

Known systems are described in U.S. Pat. No. 8,050,434 to Kato et al., U.S. Pat. No. 7,929,717 to Okabayashi et al., and U.S. Pat. No. 5,930,375 to East et al. These references are specifically incorporated by reference herein.

BRIEF SUMMARY OF THE INVENTION

Disclosed herein is a surround audio dialog balance assessment method, apparatus, and system. More particularly, disclosed herein is a surround audio dialog balance assessment method, apparatus, and system that is an audio monitor or is associated with an audio monitor. Preferred surround audio dialog balance assessment methods, apparatuses, and systems automate the process of monitoring audio signals through a broadcast chain by substituting an intelligent device for the overworked, expensive, drudgery avoiding humans previously used to accomplish the task.

Disclosed herein is a method for performing a surround audio dialog balance assessment on a plurality of original surround channels, at least one of the original surround channels capable of transmitting dialog. This method includes the steps of: (a) measuring loudness of a dialog transmitting channel to obtain a dialog transmitting channel loudness; (b) measuring loudness of the original surround channels excluding the dialog transmitting channel to obtain a non-dialog channel loudness; (c) comparing the dialog transmitting channel loudness to the non-dialog channel loudness; and (d) displaying the results of the previous steps (a)-(c). The method may further include the steps of: (a) suspending the step of comparing the dialog transmitting channel loudness to the non-dialog channel loudness if dialog is not present; and (b) indicating that suspension of comparing has occurred. The method may further include the steps of: (a) comparing the dialog transmitting channel loudness to a loudness threshold value to determine if dialog is present; (b) suspending the step of comparing the dialog transmitting channel loudness to the non-dialog channel loudness if dialog is not present; and (c) indicating that suspension of comparing has occurred. The method may further include the steps of: (a) determining if dialog is present on the dialog transmitting channel using a voice activity detector; (b) suspending the step of comparing the dialog transmitting channel loudness to the non-dialog channel loudness if dialog is not present; and (c) indicating that suspension of comparing has occurred.

Disclosed herein is a method for performing a surround audio dialog balance assessment on a plurality of original surround channels, at least one of the original surround channels capable of transmitting dialog, the method comprising the steps of: (a) measuring loudness of a dialog transmitting channel to obtain a dialog transmitting channel loudness; (b) downmixing the original surround channels except for the channel containing dialog into Left and Right stereo channels; (c) measuring the loudness of the stereo channels to obtain stereo channel loudness; (d) comparing the dialog transmitting channel loudness to the stereo channel loudness; (e) displaying the results of the previous steps (a)-(d). The method may further include the steps of: (a) suspending the step of comparing the dialog transmitting channel loudness to the stereo channel loudness if dialog is not present; and (b) indicating that suspension of comparing has occurred. The method may further include the steps of: (a) comparing the dialog transmitting channel loudness to a loudness threshold value to determine if dialog is present; (b) suspending the step of comparing the dialog transmitting channel loudness to the stereo channel loudness if dialog is not present; and (c) indicating that suspension of comparing has occurred. The method may further include the steps of: (a) determining if dialog is present on the dialog transmitting channel using a voice activity detector; (b) suspending the step of comparing the dialog transmitting channel loudness to the stereo channel loudness if dialog is not present; and (c) indicating that suspension of comparing has occurred.

These methods may be implemented as systems and/or apparatuses.

The foregoing and other objectives, features, and advantages of the invention will be more readily understood upon consideration of the following detailed description of the invention, taken in conjunction with the accompanying drawings.

BRIEF DESCRIPTION OF THE SEVERAL VIEWS OF THE DRAWINGS

The accompanying drawings are incorporated in and constitute a part of this specification.

DETAILED DESCRIPTION OF THE INVENTION

As set forth, disclosed herein is a surround audio dialog balance assessment method, apparatus, and system (referred to jointly as the "surround audio dialog balance assessment system"). More particularly, disclosed herein is a surround audio dialog balance assessment system that is an audio monitor or is associated with an audio monitor. Preferred surround audio dialog balance assessment systems automate the process of monitoring audio signals through a broadcast chain by substituting an intelligent device for the overworked, expensive, drudgery avoiding humans previously used to accomplish the task. Preferred surround audio dialog balance assessment systems provide a more accurate assessment of the balance of dialog in a surround sound program. Further, preferred surround audio dialog balance assessment systems reduce the attention required of the operator in monitoring surround sound program dialog balance. Finally, preferred surround audio dialog balance assessment systems address the limitations of current practice and take into account the user's needs and wants. For example, the user does not want to monitor multiple meters and perform visual comparisons. The user wants a direct indication of dialog balance.

Mix engineers commonly judge channel balance by measuring levels. One purpose of measuring levels in broadcast programs is to monitor the balance of the level of dialog relative to the level of other sounds. In North America and Japan this is usually done with volume unit (VU) meters. In Europe and much of the rest of the world, levels are often measured through peak program meters (PPM). Although levels can be a useful proxy for loudness, levels are frequently inaccurate. Any inaccuracy of the loudness assessment results in inaccuracy of the balance estimate. A fundamental error in monitoring dialog balance, therefore, stems from the reliance on these non-frequency selective, amplitude-based assessments inherent to level measurements. The simple measurements of the volume unit (VU) meters and peak program meters (PPM) do not consider many aspects of the human auditory system.

To better assess the relative balance of the dialog, it is necessary to base judgments on loudness. It is well recognized that the human ear is frequency selective and that it responds to signal power, not amplitude (extent of a vibration or oscillation). Extensive study with human listeners and typical broadcast program material has resulted in the International Telecommunications Union (ITU) standard BS-1770. This standardizes a technique for assessing loudness based on filtering to match the human ears' frequency response and measurements of individual channel power FIG. 2.

Figure 1:
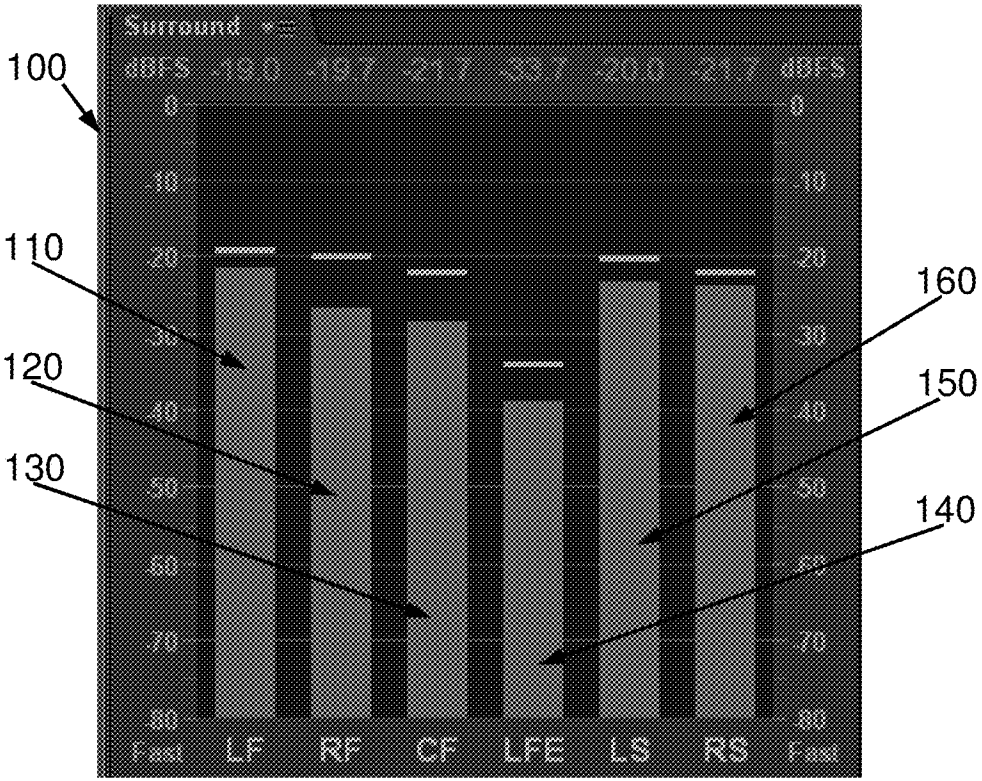
FIG. 1 (Prior Art)
FIG. 1 is an exemplary display of a typical surround sound level meter display.
Figure 2:
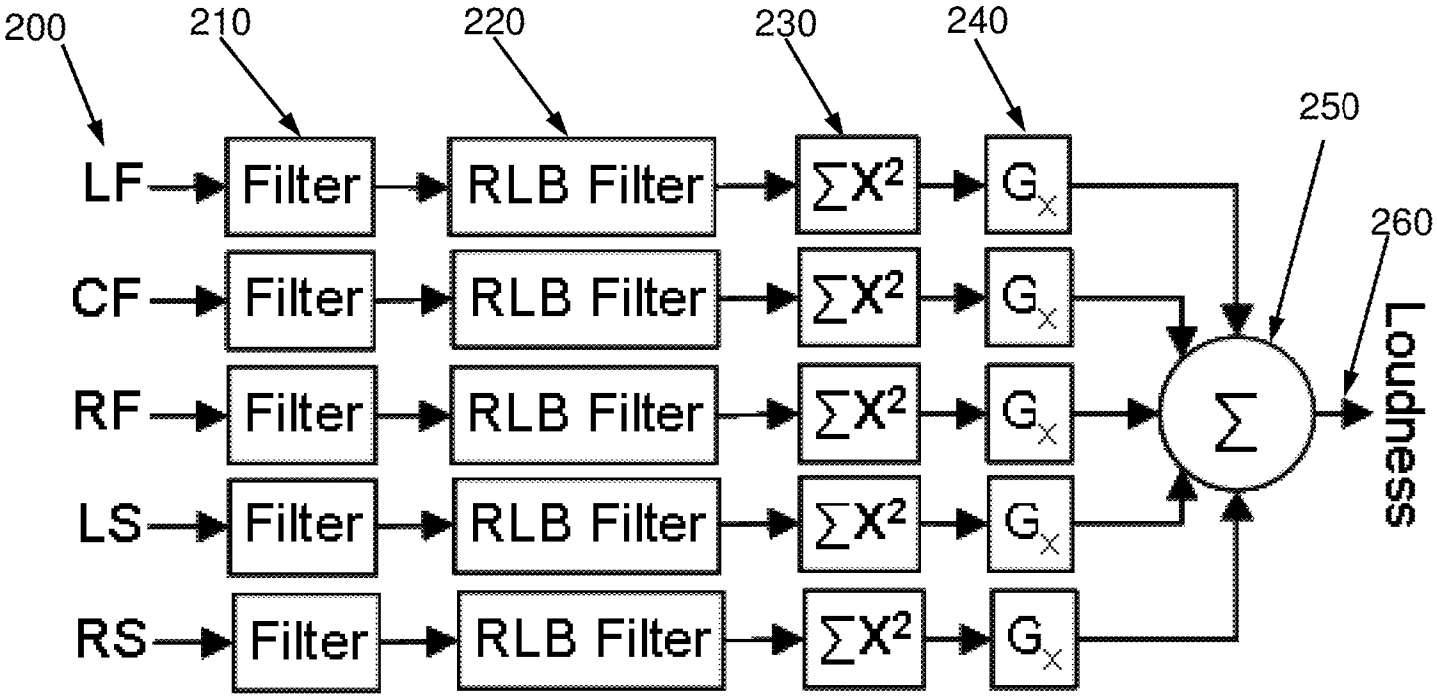
FIG. 2 (Prior Art)
FIG. 2 is a block diagram of the ITU standard loudness measurement method.

As shown in FIG. 2, the ITU standard BS-1770 technique processes all the channels 200 (except for the low frequency effects (LFE) channel) using a two-pole high-pass filter 210 and a high frequency shelving filter 220 (shown as an RLB Filter in FIG. 2). The high frequency shelving filter 220 simulates the acoustic shadowing introduced by the human head. The two-pole high-pass filter 210 mimics the attenuation of low frequencies by the human ear. The LFE channel is omitted because its energy is limited to frequencies below the cutoff of this high pass filter, and so filtering the LFE channel would have a negligible effect on the result. After filtering, power measurements are performed on each channel individually 230. The direction dependent behavior of head shadowing is overcome by boosting the gain of left surround and right surround channels by 1.5 dB 240. These channel powers are combined to yield a single measurement representing the instantaneous or overall loudness measurement 260 of the surround program.

Since the human hearing system does not respond instantaneously, time averaging is applied to this overall loudness measurement 260. An averaging time of 400 ms is specified to obtain a measurement of "momentary loudness" (a momentary loudness value) and is commonly used to drive meter displays when a dynamic indication like that obtained from VU meters is desired. A three-second averaging is used to obtain a measurement of "short-term loudness" (a short-term loudness value) simulating the processing time listeners use when judging the overall loudness of continuous surround program material.

Loudness Assessment

A direct application of loudness measurement to the conventional relative level technique used by mix engineers would be to compare the loudness of the center front channel (the exemplary dialog transmitting channel) to the loudness of the left front and right front channels. This would represent an improvement, but would still not properly assess what is heard by the human ear when listening to the surround program.

Adding the left surround channel and right surround channel to the comparison would better represent the total sound that can mask the center front content (the dialog on the dialog transmitting channel). This could be accomplished with two loudness measurements, one on the center front channel and one on the remaining four channels. This, however, would be a suboptimal assessment method because of the directional dependence of human hearing.

Directional Dependence

The human hearing system can use the directional separation of the sources to isolate a desired sound from competing sounds. This is commonly referred to as "the cocktail party effect" since this ability is what enables an individual to focus on a desired talker in a room full of other talkers. In a surround sound presentation of a television or film program listeners can use this ability to pick out the dialog since the dialog comes from a speaker directly in front of the listener while the competing program content is distributed around the room in the other speakers.

Despite the availability of surround sound reproduction, most viewers still listen to television programming in stereo. Many viewing spaces simply cannot accommodate the additional speakers required and many viewers cannot afford the additional hardware. When stereo televisions receive a surround broadcast they combine the channels in a process called "downmixing." The terms "downmixing" and "downmix" are used to describe the process of manipulating audio where a number of distinct audio channels are mixed together to produce a lower number of channels. Downmixing is sometimes also referred to as fold-down.

Assuming that the end-user's reproduction equipment operates in an ATSC (Dolby Digital) environment and is converting a 5.1 surround program to stereo, commonly used equations are as follows:

$$L=LF+CF*CF\text{ Gain}+LS*S\text{ Gain} \quad (1)$$

$$R=RF+CF*CF\text{ Gain}+RS*S\text{ Gain} \quad (2)$$

Center front gain (CF Gain) 331 and surround gain (S Gain) 361 are the increases in volume of the respective channels.

Figure 3:
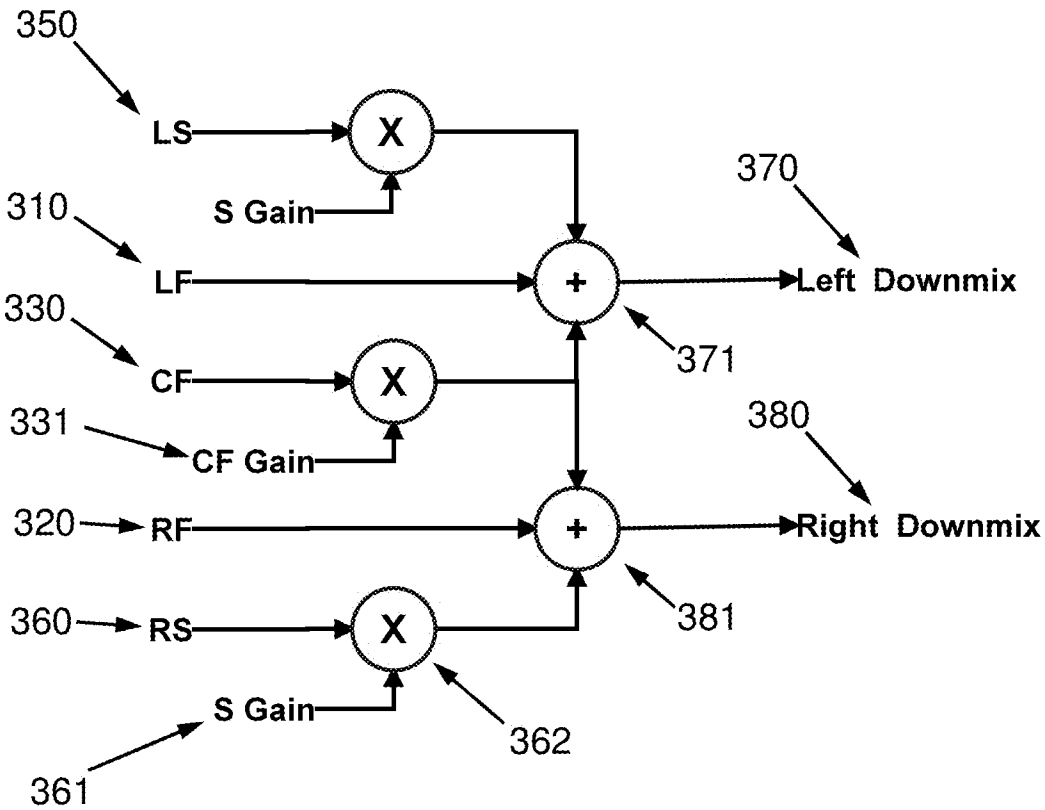
FIG. 3 (Prior Art)
FIG. 3 is a block diagram of a common method for downmixing surround sound programs to stereo.

FIG. 3 graphically shows the original surround channels 310, 320, 330, 350, 360 being downmixed into Left L 370 and Right R 380 stereo channels. (If a channel only carries one signal, it would be equally appropriate to describe the original surround channels being downmixed into Left and Right stereo "signals.") The downmix equations used by the end-user's reproduction equipment may be contained in metadata traveling with some digital formats (such as Dolby AC3), may be an industry standard, and/or the user may explicitly set them. U.S. Pat. No. 7,450,727 to Greisinger, U.S. Pat. No. 7,394,903 to Herre et al., and U.S. Pat. No. 5,946,352 to Rowlands et al. describe downmixing in more detail and provide examples thereof. These references are herein incorporated by reference in their entirety.

Regardless of the specific equations used, when the surround program is reproduced in stereo, the center front channel (the dialog transmitting channel) is mixed into the left and right channels. During stereo reproduction, the left front and left surround channels are also mixed into the left channel while the right front and right surround channels are mixed into the right channel. Therefore, in stereo reproduction, the dialog in the center front directly competes with the other content (competing program content) in the left and right channels. The dialog no longer has the advantage of directional separation so it is much harder for the listener to understand the dialog in the presence of loud sounds (competing program content) from the other channels in the original surround program. Since stereo is the most common format for broadcast program reproduction, this is a situation that must be monitored.

Surround Audio Dialog Balance Assessment System

Figure 4:
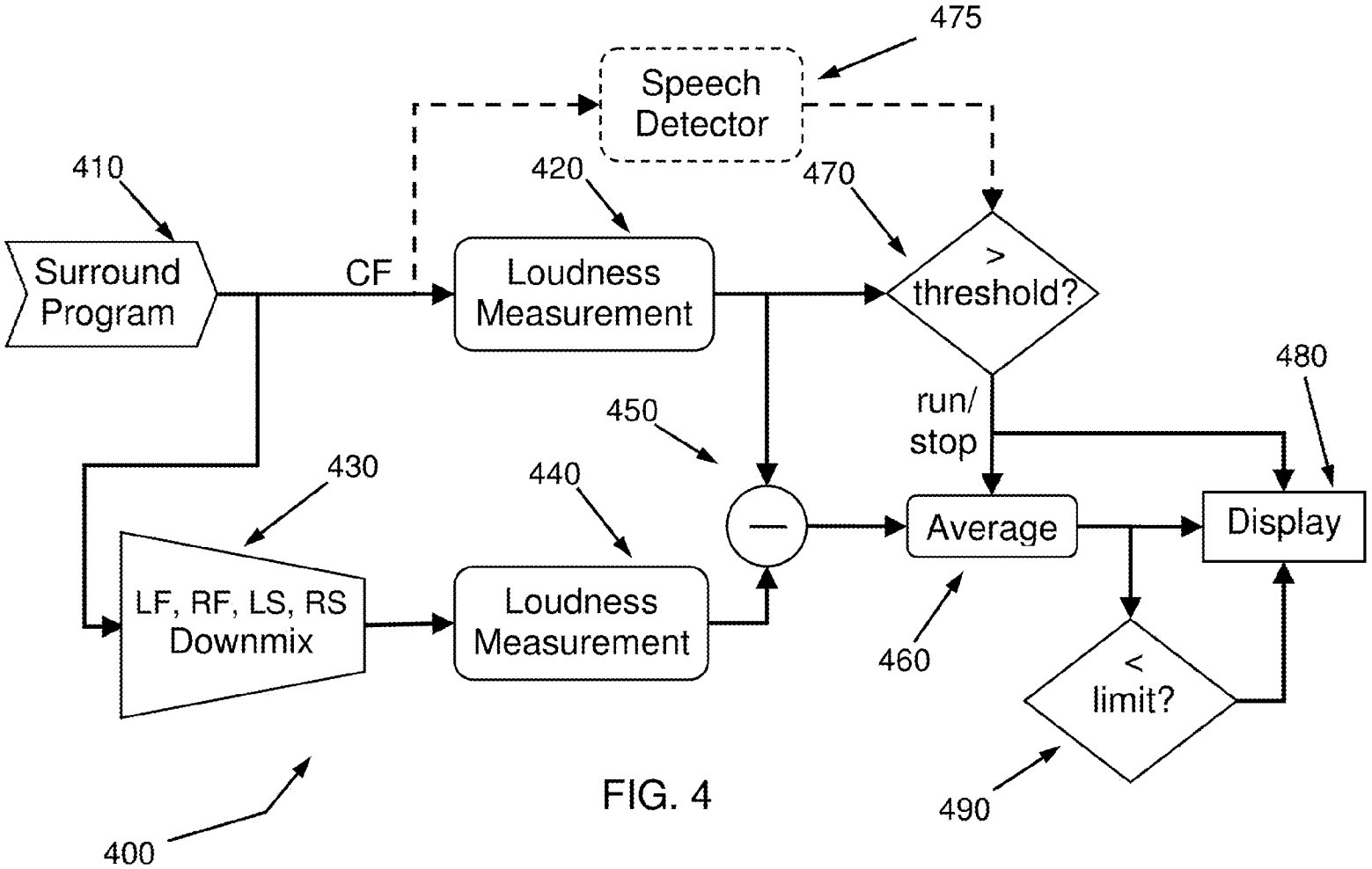
FIG. 4 is a block diagram of an exemplary preferred system for surround audio dialog balance assessment.

The basic exemplary surround audio dialog balance assessment system 400 described herein is diagrammed in FIG. 4. To properly assess the dialog balance of dialog in a surround program being mixed, it is necessary to compare its loudness to that of the remaining content (competing program content) after downmixing. Consequently the surround program 410 channels are split and one channel's loudness, typically the center front channel (or whichever channel is used as the dialog transmitting channel), is measured 420 separately from the loudness of the other channels (the original surround channels excluding the dialog transmitting channel which can also be referred to as the "non-dialog channels"). In other words, a measurement is taken of the loudness of a dialog transmitting channel to obtain a dialog transmitting channel loudness and, separately, a measurement is taken of the loudness of the non-dialog channels to obtain a non-dialog channel loudness. Since the goal is to measure the balance of one channel relative to the other channels, a downmix 430 must be created that eliminates this channel's signal. Using the center front signal as an example of the dialog transmitting channel, this results in the following equations for the non-dialog channels:

$$L=LF+LS*S\text{ Gain} \quad (3)$$

$$R=RF+RS*S\text{ Gain} \quad (4)$$

This is equivalent to setting the CF Gain 331 in FIG. 3 to zero.

The loudness of the center front signal 420 (the dialog transmitting channel loudness) and the loudness of the downmixed stereo signal without the center front 440 (the non-dialog channel loudness) are thus obtained. In the preferred surround audio dialog balance assessment system 400, these loudness computations are preferably performed using the 400 ms momentary loudness averaging time to produce a momentary loudness value. The momentary loudness time constant (400 ms) is similar to the duration of basic speech components that make the result roughly model the perceptibility of these speech components. Although a momentary loudness time constant could be optimized for improved modeling of speech perception, there are practical advantages to using those momentary loudness time constants specified in the existing loudness standard.

Figures 5, 6, 7:
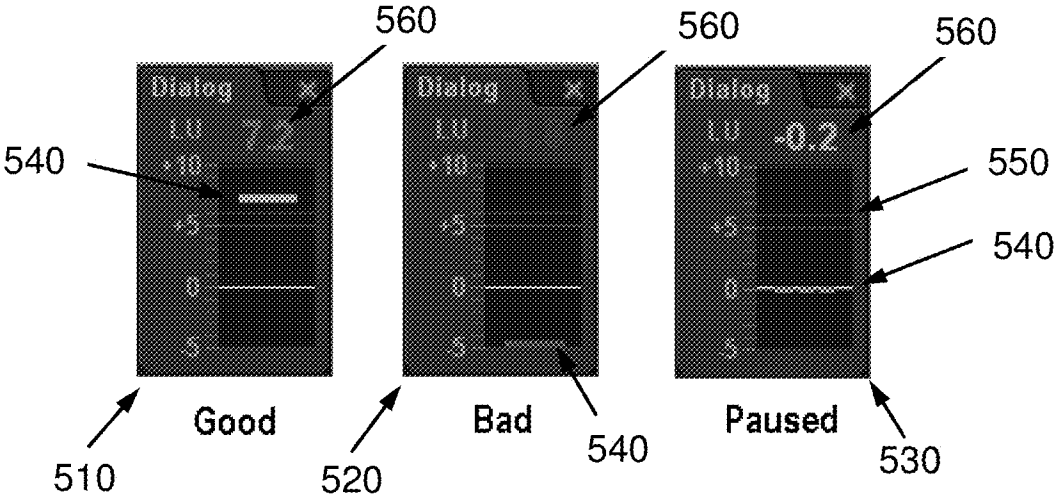
FIG. 5 is an exemplary display generated by a preferred surround audio dialog balance assessment method, apparatus, and system described herein, the display showing a "good" state in which the minimum value has been reached.
FIG. 6 is an exemplary display generated by a preferred surround audio dialog balance assessment method, apparatus, and system described herein, the display showing a "bad" state in which the minimum value has not been reached.
FIG. 7 is an exemplary display generated by a preferred surround audio dialog balance assessment method, apparatus, and system described herein, the display showing a "paused" state in which the reading is not currently being computed.

Since the loudness units (LU) of the ITU standard loudness measurement method are a logarithmic result, these two values (the loudness of the center front signal 420 and the loudness of the downmixed stereo signal without the center front 440) can be compared by a simple subtraction 450. (Subtraction in the log domain corresponds to division, or a ratio, in a linear domain.) The difference may be displayed 480 (examples of which are shown in FIGS. 5-7) expressed in the same loudness units (LU).

To better track human perception of these differences, the resulting values (the loudness of the center front signal 420 and the loudness of the downmixed stereo signal without the center front 440) are processed with a running three-second average 460 (producing a short-term loudness value). This additional averaging step produces a short-term loudness value that varies slowly enough to be read numerically.

Figure 8:
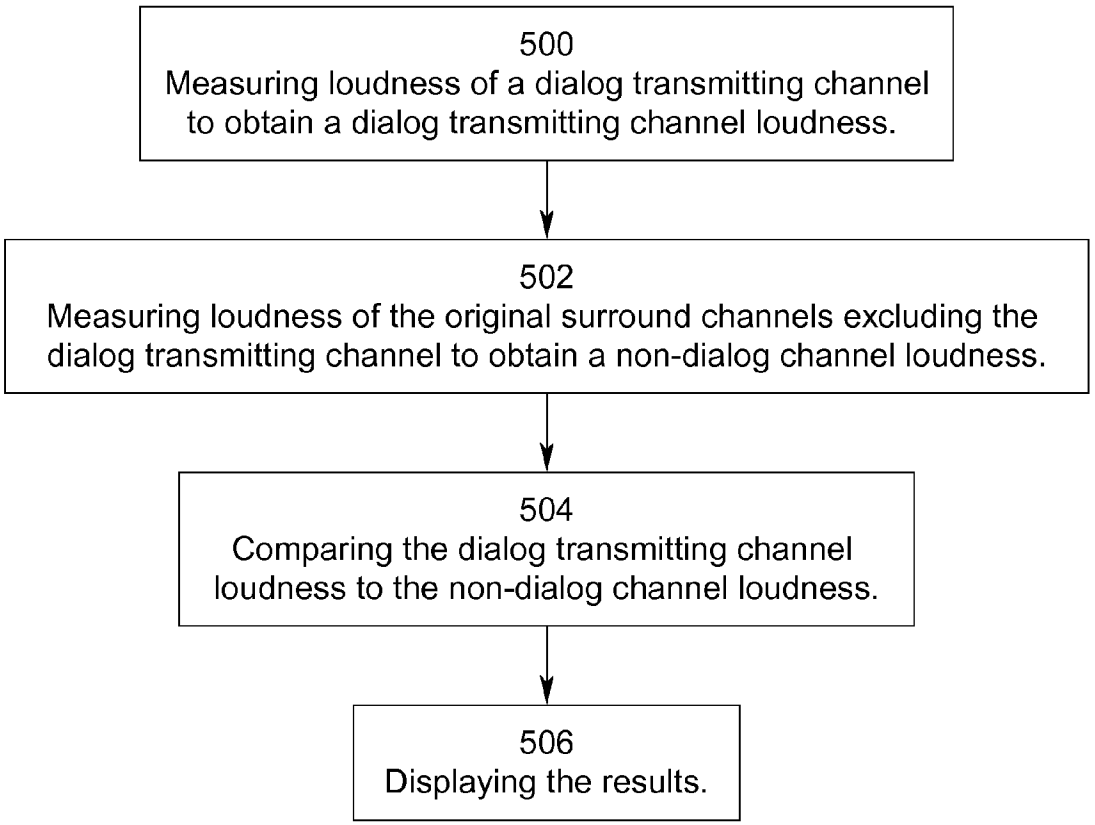
FIG. 8 is a flowchart showing a method, apparatus, or system for performing a surround audio dialog balance assessment on a plurality of original surround channels, at least one of the original surround channels capable of transmitting dialog.

FIG. 8 shows a flowchart for performing a surround audio dialog balance assessment on a plurality of original surround channels, at least one of the original surround channels capable of transmitting dialog. Block 500 shows measuring loudness of a dialog transmitting channel to obtain a dialog transmitting channel loudness. Block 502 shows measuring loudness of the original surround channels excluding the dialog transmitting channel to obtain a non-dialog channel loudness. Block 504 shows comparing the dialog transmitting channel loudness to the non-dialog channel loudness. Block 506 shows displaying the results of the previous steps.

Figure 9:
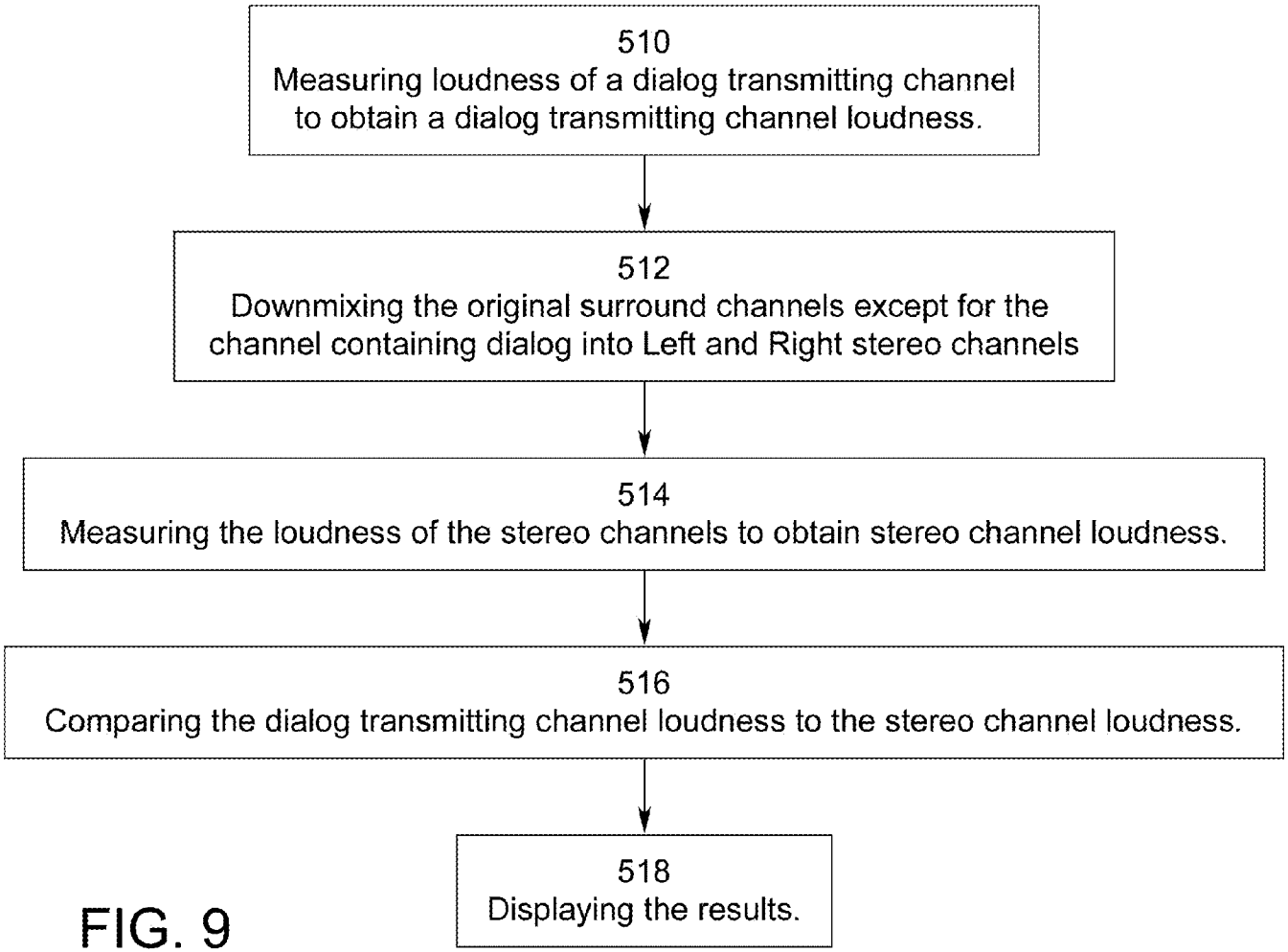
FIG. 9 is a flowchart showing a method, apparatus, or system for performing a surround audio dialog balance assessment on a plurality of original surround channels, at least one of the original surround channels capable of transmitting dialog, the original surround channels except for the channel containing dialog being downmixed into Left and Right stereo channels.

FIG. 9, as compared to FIG. 8, is directed to a system in which the stereo format for broadcast program reproduction is considered. Specifically, FIG. 9 shows a flowchart for performing a surround audio dialog balance assessment on a plurality of original surround channels, at least one of the original surround channels capable of transmitting dialog. Block 510 shows measuring loudness of a dialog transmitting channel to obtain a dialog transmitting channel loudness. Block 512 shows downmixing the original surround channels except for the channel containing dialog into Left and Right stereo channels. Block 514 shows measuring the loudness of the stereo channels to obtain stereo channel loudness. Block 516 shows comparing the dialog transmitting channel loudness to the stereo channel loudness. Block 518 shows displaying the results of the previous steps.

Absence of Dialog

Since there are frequent periods of no dialog, it is preferable to compute the indication only when dialog is present. Otherwise the ratio of dialog to remaining content (competing program content) will be reduced by the fraction of time that dialog is not present. To determine the presence of dialog, the center front loudness may be compared to a loudness threshold value (using a loudness threshold comparing element 470) that must be exceeded for the averaging 460 to be performed. A typical value for this loudness threshold value is 40 loudness units (LU) below full scale or 15 loudness units below the typical loudness of the speech. The preferred surround audio dialog balance assessment system 400 preferably allows the user to select a loudness threshold value from a range of choices around this typical value.

The presence of dialog may optionally be determined with a voice activity detector (VAD) 475 as shown in dashed lines in FIG. 4. Such devices and algorithms are well known in the telecommunications industry and are used in many voice coding algorithms. U.S. Pat. No. 5,878,391 to Aarts, U.S. Pat. No. 6,061,647 to Barrett, and U.S. Pat. No. 6,658,380 to Lockwood et al. describe voice activity detectors in more detail and provide examples thereof. These references are herein incorporated by reference in their entirety.

If a voice activity detector 475 is employed, its output may replace that of the loudness threshold comparing element 470 and control the averaging element 460 directly. Alternatively, the output of the voice activity detector 475 may be combined with the output of the loudness threshold comparing element 470 using a logical AND function to insure that dialog (speech) is present and its loudness exceeds a minimum value.

Testing the Surround Audio Dialog Balance Measurement

Since one original goal of the surround audio dialog balance assessment system 400 was to automatically detect problems in surround audio dialog balance, the surround audio dialog balance measurement preferably should be tested, not just displayed. The value determined after averaging (the short-term loudness value) may be compared to a minimum limit 490 representing the minimum amount the user believes the dialog loudness must exceed the remaining surround program (competing program content) loudness to be correctly understood. If this minimum is not met, the user may be warned so corrective action may be taken. Since people in charge of mixing or monitoring audio will have differing opinions of what constitutes a problem, preferred surround audio dialog balance assessment systems will have several selectable parameters for the minimum limit 490 that may be used to define an a problem or "error." For example, the minimum amount by which the loudness of the dialog must exceed the loudness of the remaining surround program (competing program content) is preferably selectable in 1 dB steps from 0 dB to 6 dB.

As with any subjective assessment, duration is preferably considered. Suppose a broadcast program contains a brief instant, perhaps due to shifting positions of actors relative to microphones, in which there is inadequate dialog loudness. This is unlikely to significantly affect dialog or to be noticed by viewers. If, however, such a condition lasted for 30 seconds the inadequate dialog loudness most likely would significantly affect dialog or to be noticed by viewers. Consequently the surround audio dialog balance assessment preferably includes a user selectable duration threshold (not shown).

Results and Display

If the dialog loudness is adequate to be intelligible above the other content in the surround program (competing program content), it is desirable for the adequacy to be readily apparent to the user. Similarly, if the dialog loudness is inadequate to be intelligible above the other content in the surround program (competing program content), it is desirable for the inadequacy to be readily apparent to the user. If the surround audio dialog balance assessment has not been recently performed, it is desirable to indicate this to the user.

FIGS. 5-7 illustrate an exemplary preferred display that might result from the surround audio dialog balance assessment system 400. The exemplary display shows both graphical 540 and numeric 560 elements are used to communicate the results. In addition, color may be changed (e.g. changing the color of the graphical element 540 and/or numeric element 560) to indicate that the minimum value 550 is reached 510 (the "good" state of FIG. 5), the minimum value 550 has not been reached 520 (the "bad" state of FIG. 6), or that the reading is not currently being computed and the displayed value is "stale" 530 (the "paused" state of FIG. 7). In addition to or instead of changing the color of the graphical element 540 and/or numeric element 560, shape, size, shading, intensity, and/or other visual indications for the purpose of distinguishing the different states.

Other methods of indicating the results (or different states) to the user may be used without departing from the spirit of the invention. For example, the measurement values may be graphed, a warning light may be illuminated if the measurement falls below the minimum required value, an audible indication (e.g. a message, beeps, or tones), etc.

Similarly, the entire measurement process and the reporting of results may be performed in a file-based environment in which the audio signal is stored in digital form, the audio signal is checked by a computer or software program that processes the signals according to the method described herein, and the user is notified by placing results in a file and/or delivering the results using some other notification means (e.g. email, text messaging, etc.).

Implementation

The surround audio dialog balance assessment system 400 may be implemented as a method (e.g. a series of steps performed by an apparatus such as an audio monitor or a computer), an apparatus (e.g. an audio monitor or a computer), and/or a system (e.g. a processor and/or memory for controlling an audio monitor or a computer). The surround audio dialog balance assessment system 400 may be embodied in software, firmware, hardware, and other forms that achieve the function described herein. The surround audio dialog balance assessment system 400 may be a computer or software program or may be implemented by a computer or software program that is tangibly embodied in a computer-readable storage device for execution by a computer processor.

FIGS. 8 and 9 are flow charts illustrating methods, apparatus, and systems. It will be understood that each block of these flow charts, components of all or some of the blocks of these flow charts, and/or combinations of blocks in these flow charts, may be implemented by software (e.g. coding, software, computer program instructions, software programs, subprograms, or other series of computer-executable or processor-executable instructions), by hardware (e.g. processors, memory), by firmware, and/or a combination of these forms. As an example, in the case of software, computer program instructions (computer-readable program code) may be loaded onto a computer to produce a machine, such that the instructions that execute on the computer create structures for implementing the functions specified in the flow chart block or blocks. These computer program instructions may also be stored in a memory that can direct a computer to function in a particular manner, such that the instructions stored in the memory produce an article of manufacture including instruction structures that implement the function specified in the flow chart block or blocks. The computer program instructions may also be loaded onto a computer to cause a series of operational steps to be performed on or by the computer to produce a computer implemented process such that the instructions that execute on the computer provide steps for implementing the functions specified in the flow chart block or blocks.

Definitions

Please note that the terms and phrases may have additional definitions and/or examples throughout the specification. Where otherwise not specifically defined, words, phrases, and acronyms are given their ordinary meaning in the art. The following paragraphs provide some of the definitions for terms and phrases used herein.

The terms "computer," "processor," and "processing unit" are defined as devices capable of executing instructions or steps and may be implemented as a programmable logic device or other type of programmable apparatus known or yet to be discovered. These devices may have associated memory. These devices may be implemented using known or yet to be discovered technology including, for example, a general purpose processor (e.g. microprocessor, controller, microcontroller, or state machine), a digital signal processor (DSP), an application specific integrated circuit (ASIC), a field programmable gate array signal (FPGA) or other programmable logic device, discrete gate or transistor logic, discrete hardware components, or any combination thereof designed to perform the functions described herein. Although shown as distinct units, it should be noted that the processing units may be implemented as a plurality of separate processing units. Similarly, multiple processors may be combined.

The term "memory" is defined to include any type of computer (or other technology)-readable media (also referred to as machine-readable storage medium) including, but not limited to the following: attached storage media (e.g. hard disk drives, network disk drives, servers), internal storage media (e.g. RAM, ROM, EPROM, FLASH-EPROM, or any other memory chip or cartridge), removable storage media (e.g. CDs, DVDs, flash drives, memory cards, floppy disks, flexible disks), firmware, and/or other storage media known or yet to be discovered. Although shown as single units, it should be noted that the memories may be implemented as a plurality of separate memories. Similarly, multiple memories may be combined. For example, the first computer or software program may be stored in a memory separate from the memory in which the second computer or software program is stored. Another example is that the data used by the first server and/or the data used by the second server may be stored in distinct memories (not shown) accessible by the servers, or the data may be stored in the shared memory made accessible by the servers. Depending on its purpose, the memory may be transitory and/or non-transitory.

Appropriate "signals," "communications," and/or "transmissions" (which include various types of information and/or instructions including, but not limited to audio signals, data, commands, and/or any combination thereof) over appropriate "signal paths," "communication paths," "transmission paths," and other means for signal transmission (including any type of connection between two elements on the system would be used as appropriate to facilitate the traveling of signals, communications, and controls.

It should be noted that the phrases "computer or software programs" and "computer or software subprograms" are defined as a series of instructions that may be implemented as software (i.e. computer program instructions or computer-readable program code) that may be loaded onto a computer to produce a machine, such that the instructions that execute on the computer create structures for implementing the functions described herein or shown in the figures. Further, these computer or software programs and subprograms may be loaded onto a computer so that they can direct the computer to function in a particular manner, such that the instructions produce an article of manufacture including instruction structures that implement the function specified in the flow chart block or blocks. The computer or software programs and subprograms may also be loaded onto a computer to cause a series of operational steps to be performed on or by the computer to produce a computer implemented process such that the instructions that execute on the computer provide steps for implementing the functions specified in the flow chart block or blocks. The phrase "loaded onto a computer" also includes being loaded into the memory of the computer or a memory associated with or accessible by the computer.

The shown computer or software programs and subprograms may be divided into multiple modules or may be combined.

The term "associated" is defined to mean integral or original, retrofitted, attached, or positioned near. For example, if a display (or other component) is associated with a computer (or other technology), the display may be an original display built into the computer, a display that has been retrofitted into the computer, an attached display that is attached to the computer, and/or a nearby display that is positioned near the computer.

Unless specifically stated otherwise, the term "exemplary" is meant to indicate an example, representative, and/or illustration of a type. The term "exemplary" does not necessarily mean the best or most desired of the type.

The terms "may," "might," "can," and "could" are used to indicate alternatives and optional features and only should be construed as a limitation if specifically included in the claims.

It should be noted that, unless otherwise specified, the term "or" is used in its nonexclusive form (e.g. "A or B" includes A, B, A and B, or any combination thereof, but it would not have to include all of these possibilities). It should be noted that, unless otherwise specified, "and/or" is used similarly (e.g. "A and/or B" includes A, B, A and B, or any combination thereof, but it would not have to include all of these possibilities). It should be noted that, unless otherwise specified, the term "includes" means "comprises" (e.g. a device that includes or comprises A and B contains A and B but optionally may contain C or additional components other than A and B). It should be noted that, unless otherwise specified, the singular forms "a," "an," and "the" refer to one or more than one, unless the context clearly dictates otherwise.

It is to be understood that the inventions, examples, and embodiments described herein are not limited to particularly exemplified materials, methods, and/or structures. It is to be understood that the inventions, examples, and embodiments described herein are to be considered preferred inventions, examples, and embodiments whether specifically identified as such or not.

All references (including, but not limited to, publications, patents, and patent applications) cited herein, whether supra or infra, are hereby incorporated by reference in their entirety.

The terms and expressions that have been employed in the foregoing specification are used as terms of description and not of limitation, and are not intended to exclude equivalents of the features shown and described. While the above is a complete description of selected embodiments of the present invention, it is possible to practice the invention use various alternatives, modifications, adaptations, variations, and/or combinations and their equivalents. It will be appreciated by those of ordinary skill in the art that any arrangement that is calculated to achieve the same purpose may be substituted for the specific embodiment shown. It is also to be understood that the following claims are intended to cover all of the generic and specific features of the invention herein described and all statements of the scope of the invention that, as a matter of language, might be said to fall therebetween.

What is claimed is:

1. A method for performing a surround audio dialog balance assessment on a plurality of original surround channels, at least one of said original surround channels capable of transmitting dialog, said method comprising the steps of:

(a) measuring loudness of a dialog transmitting channel to obtain a dialog transmitting channel loudness;

(b) measuring a combined loudness of said original surround channels excluding said dialog transmitting channel to obtain a non-dialog channel loudness;

(c) comparing said dialog transmitting channel loudness to said non-dialog channel loudness; and (d) displaying the results of the previous steps (a)-(c).

2. The method of claim 1, further comprising the steps of:

(a) suspending said step of comparing said dialog transmitting channel loudness to said non-dialog channel loudness if dialog is not present; and (b) indicating that suspension of comparing has occurred.

3. The method of claim 1, further comprising the steps of:

(a) comparing said dialog transmitting channel loudness to a loudness threshold value to determine if dialog is present;

(b) suspending said step of comparing said dialog transmitting channel loudness to said non-dialog channel loudness if dialog is not present; and (c) indicating that suspension of comparing has occurred.

4. The method of claim 1, further comprising the steps of:

(a) determining if dialog is present on said dialog transmitting channel using a voice activity detector;

(b) suspending said step of comparing said dialog transmitting channel loudness to said non-dialog channel loudness if dialog is not present; and (c) indicating that suspension of comparing has occurred.

5. The method of claim 1, further comprising the step of downmixing said original surround channels excluding said dialog transmitting channel.

6. The method of claim 1, wherein said step of displaying the results further comprises the step of displaying the results on a single display.

7. A method for performing a surround audio dialog balance assessment on a plurality of original surround channels, at least one of said original surround channels capable of transmitting dialog, said method comprising the steps of:

(a) measuring loudness of a dialog transmitting channel to obtain a dialog transmitting channel loudness;

(b) downmixing said original surround channels, except for said channel containing dialog, into Left and Right stereo channels;

(c) measuring a combined loudness of said stereo channels to obtain a stereo channel loudness;

(d) comparing said dialog transmitting channel loudness to said stereo channel loudness; and (e) displaying the results of the previous steps (a)-(d).

8. The method of claim 7, further comprising the steps of:

(a) suspending said step of comparing said dialog transmitting channel loudness to said stereo channel loudness if dialog is not present; and (b) indicating that suspension of comparing has occurred.

9. The method of claim 7, further comprising the steps of:

(a) comparing said dialog transmitting channel loudness to a loudness threshold value to determine if dialog is present;

(b) suspending said step of comparing said dialog transmitting channel loudness to said stereo channel loudness if dialog is not present; and (c) indicating that suspension of comparing has occurred.

10. The method of claim 7, further comprising the steps of:

(a) determining if dialog is present on said dialog transmitting channel using a voice activity detector;

(b) suspending said step of comparing said dialog transmitting channel loudness to said stereo channel loudness if dialog is not present; and (c) indicating that suspension of comparing has occurred.

11. The method of claim 7, wherein said step of displaying the results further comprises the step of displaying the results on a single display.

12. An audio dialog balance assessment system for performing an audio dialog balance assessment on a plurality of original channels, at least one of said original channels capable of transmitting dialog, said system comprising:

(a) means for measuring loudness of a dialog transmitting channel to obtain a dialog transmitting channel loudness;

(b) means for downmixing said original channels excluding said dialog transmitting channel;

(c) means for measuring a combined loudness of said original channels excluding said dialog transmitting channel to obtain a non-dialog channel loudness;

(d) means for comparing said dialog transmitting channel loudness to said non-dialog channel loudness; and (e) means for displaying the results from (a)-(d).

13. The system of claim 12, further comprising:

(a) means for suspending the comparing of said dialog transmitting channel loudness to said non-dialog channel loudness if dialog is not present; and (b) means for indicating that suspension of comparing has occurred.

14. The system of claim 12, further comprising:

(a) means for comparing said dialog transmitting channel loudness to a loudness threshold value to determine if dialog is present;

(b) means for suspending the comparing of said dialog transmitting channel loudness to said non-dialog channel loudness if dialog is not present; and (c) means for indicating that suspension of comparing has occurred.

15. The system of claim 12, further comprising:

(a) means for determining if dialog is present on said dialog transmitting channel using a voice activity detector;

(b) means for suspending the comparing of said dialog transmitting channel loudness to said non-dialog channel loudness if dialog is not present; and (c) means for indicating that suspension of comparing has occurred.

16. The system of claim 12, wherein said means for displaying the results is a single means for displaying the results.

17. An audio dialog balance assessment system for performing an audio dialog balance assessment on a plurality of original channels, at least one of said original channels capable of transmitting dialog, said system comprising:

(a) a loudness measurer that measures a dialog transmitting channel to obtain a dialog transmitting channel loudness;

(b) a downmixer that downmixes said original channels excluding said dialog transmitting channel;

(c) a measurer that measures a combined loudness of said original channels excluding said dialog transmitting channel to obtain a non-dialog channel loudness;

(d) a comparer that compares said dialog transmitting channel loudness to said non-dialog channel loudness; and (e) a display that displays the results from (a)-(d).

18. The system of claim 17, further comprising:

(a) a suspender that suspends the comparing of said dialog transmitting channel loudness to said non-dialog channel loudness if dialog is not present; and (b) an indicator that indicates that suspension of comparing has occurred.

19. The system of claim 17, further comprising:

(a) a comparer that compares said dialog transmitting channel loudness to a loudness threshold value to determine if dialog is present;

(b) a suspender that suspends the comparing of said dialog transmitting channel loudness to said non-dialog channel loudness if dialog is not present; and (c) an indicator that indicates that suspension of comparing has occurred.

20. The system of claim 17, further comprising:

(a) a determiner that determines if dialog is present on said dialog transmitting channel using a voice activity detector;

(b) a suspender that suspends the comparing of said dialog transmitting channel loudness to said non-dialog channel loudness if dialog is not present; and (c) an indicator that indicates that suspension of comparing has occurred.

21. The system of claim 17, wherein said display is a single display that displays the results.

* * * * *